US006764193B1

(12) United States Patent
Wei

(10) Patent No.: US 6,764,193 B1
(45) Date of Patent: Jul. 20, 2004

(54) FULL-COLOR SHOE LIGHT DEVICE

(76) Inventor: Meng Pi Wei, 3F, No. 238, Pao Ping Rd, Yungho City, Taipei Hsien (TW)

( * ) Notice: Subject to any disclaimer, the term of this patent is extended or adjusted under 35 U.S.C. 154(b) by 0 days.

(21) Appl. No.: 10/357,459

(22) Filed: Feb. 4, 2003

(51) Int. Cl.[7] ..... F21V 21/08
(52) U.S. Cl. ..... 362/103; 362/234; 362/802
(58) Field of Search ..... 362/103, 108, 362/234, 276, 800, 802; 358/17; 257/98–100; 36/134

(56) References Cited

U.S. PATENT DOCUMENTS 5,179,438 A * 1/1993 Morimoto ..... 348/536
5,392,618 A * 2/1995 Livingston et al. ..... 68/12.02
5,416,496 A * 5/1995 Wood ..... 345/102
5,575,554 A * 11/1996 Guritz ..... 362/103
5,758,946 A * 6/1998 Chen ..... 362/103
6,330,111 B1 * 12/2001 Myers ..... 359/599
6,521,916 B2 * 2/2003 Roberts et al. ..... 257/100

* cited by examiner

*Primary Examiner*—Alan Cariaso
*Assistant Examiner*—Mark Tsidulko
(74) *Attorney, Agent, or Firm*—Browdy and Neimark, P.L.L.C.

(57) ABSTRACT

A full-color shoe light device has at least a color-mixing LED, a power source, a vibration switch and a control IC. The color-mixing LED is several light-emitting chips of different colors, and is used to generate light of various colors. The power source provides electricity for the color-mixing LED. The vibration switch generates and sends a trigger signal to the control IC when vibrated. The control IC generates a drive signal to drive the color-mixing LED to emit multiple color variations in a flashing episode after receiving the trigger signal. When a wearer wearing a shoe with the full-color shoe light device installed therein walks, multiple color variations can be displayed along with his or her steps.

16 Claims, 5 Drawing Sheets

FULL-COLOR SHOE LIGHT DEVICE

FIELD OF THE INVENTION

The present invention relates to a full-color shoe light device and, more particularly, to a shoe light device capable of emitting multiple color variations through a color-mixing light-emitting diode.

BACKGROUND OF THE INVENTION

Curiosity for pursuing new things always urges people to change the present situation and to search for unusual sensual stimulation. For instance, shoes worn by people as means of transportation every day no longer only provide protection for the feet. In the pursuit of new sensual stimulation, shoe bodies have been heavily modified with regard to shape of the shoe or the color and pattern of the surface of the shoe. Lights and flashing devices have also been added to shoes. Lights and flashing devices can provide dynamic visual effects and can more easily attract attention. In particular, varying light on shoes when worn at night serve both as visual ornaments and safety devices. A shoe light device shown in FIG. 1 is installed in a shoe (not shown). In the shoe light device, a vibration switch la is connected with an input terminal of a control unit 2*a*, and several monochrome light-emitting diodes (LEDs) 3*a* (installed in visible portions of the shoe) are connected with output terminals of the control unit 2*a*. Trigger signals from the vibration switch la are received by the internal circuit of the control unit 2*a* to allow the LEDs to show four kinds of reciprocating flashing modes with 1 to 5 seconds between every flash. When a wearer wears a shoe with the shoe light device installed therein, vibration generated when walking make the vibration switch generate trigger signals. The internal circuit of the control unit 2*a* drives the LEDs 3*a* to flash in reciprocation according to the received trigger signals.

For the above conventional shoe light device, the lighting variations in practical use are accomplished only through several monochrome LEDs, hence being monotonous and not diversified and not satisfying people's need for novelty.

SUMMARY AND OBJECTS OF THE PRESENT INVENTION

The primary object of the present invention is to provide a full-color shoe light device, wherein a color-mixing LED is utilized for mixing lights of different colors to allow the shoe light device to show various kinds of beautiful colors and thus create a dazzling effect.

Another object of the present invention is to provide a full-color shoe light device, which can emit multiple color variations when a wearer wearing a shoe with the full-color shoe light device installed therein walks, hence showing novel and interesting visual effects along with his steps.

To achieve the above objects, the present invention provides a shoe light device with multiple color variations, which comprises at least a color-mixing LED, a power source, a vibration switch and a control IC. The color-mixing LED is composed of several light-emitting chips of different colors, and is used to generate light of various colors. The power source provides electricity for the color-mixing LED. The vibration switch generates a trigger signal in response to vibration. The control IC generates a drive signal to make the color-mixing LED emit multiple color variations in a flashing episode after receiving the trigger signal.

The various objects and advantages of the present invention will be more readily understood from the following detailed description when read in conjunction with the appended drawings, in which:

DETAILED DESCRIPTION OF PREFERRED EMBODIMENT

Figure 1:
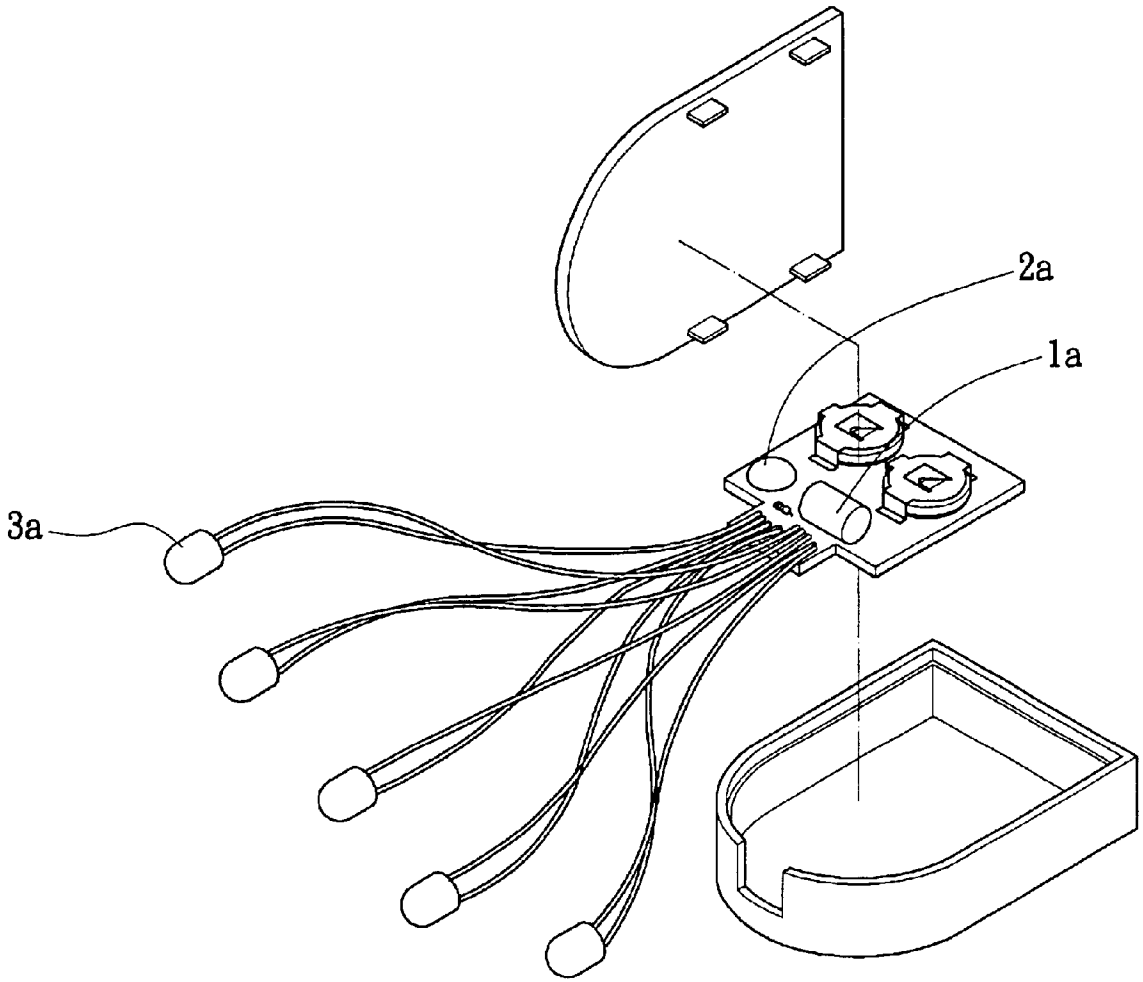
FIG. 1 PRIOR ART
FIG. 1 is an exploded perspective view of a conventional shoe light device.
Figure 2:
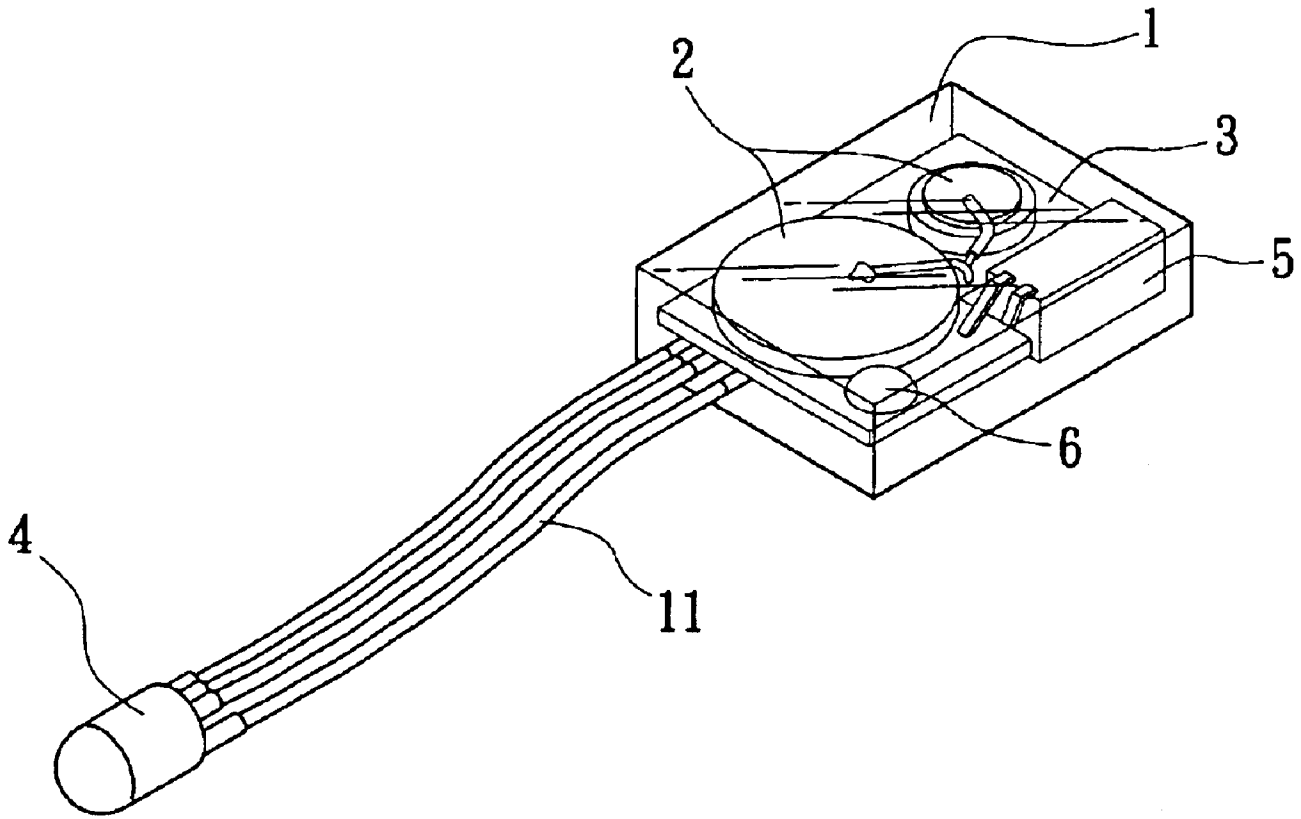
FIG. 2 is a perspective view of an embodiment of the present invention.

As shown in FIG. 2, the present invention provides a full-color shoe light device, which comprises a shell body 1, a power source 2, a substrate 3, a conductive wire 11, a color-mixing LED 4, a vibration switch 5 and a control IC 6.

The power source 2 is disposed in the shell body 1, and can provide a voltage of 4.5V or 6V. The 4.5V power source is composed of a 3V battery and a 1.5V battery; the 3V battery is a lithium battery (CR-2032 or CR-2450). The 6V power source is composed of 2 3V lithium batteries. The conductive wire 11 protrudes from the substrate 3 and extends out of the shell body 1. The other end of the conductive wire 11 is connected to the color-mixing LED 4 having 3 or 4 pins. The color-mixing LED 4 has three light-emitting chips for red (R), green (G) and blue (B), and emits lights of different colors in multiple color series by mixing. The vibration switch 5 and the control IC 6 are disposed on the substrate 3. Each time an external force (e.g., vibration) is exerted on the shell body 1, the vibration switch 5 triggers the control IC 6, which then generates a drive signal to make the color-mixing LED 4 emit multiple color variations in a flashing episode after receiving the trigger signal generated by the vibration switch 5.

Figure 3:
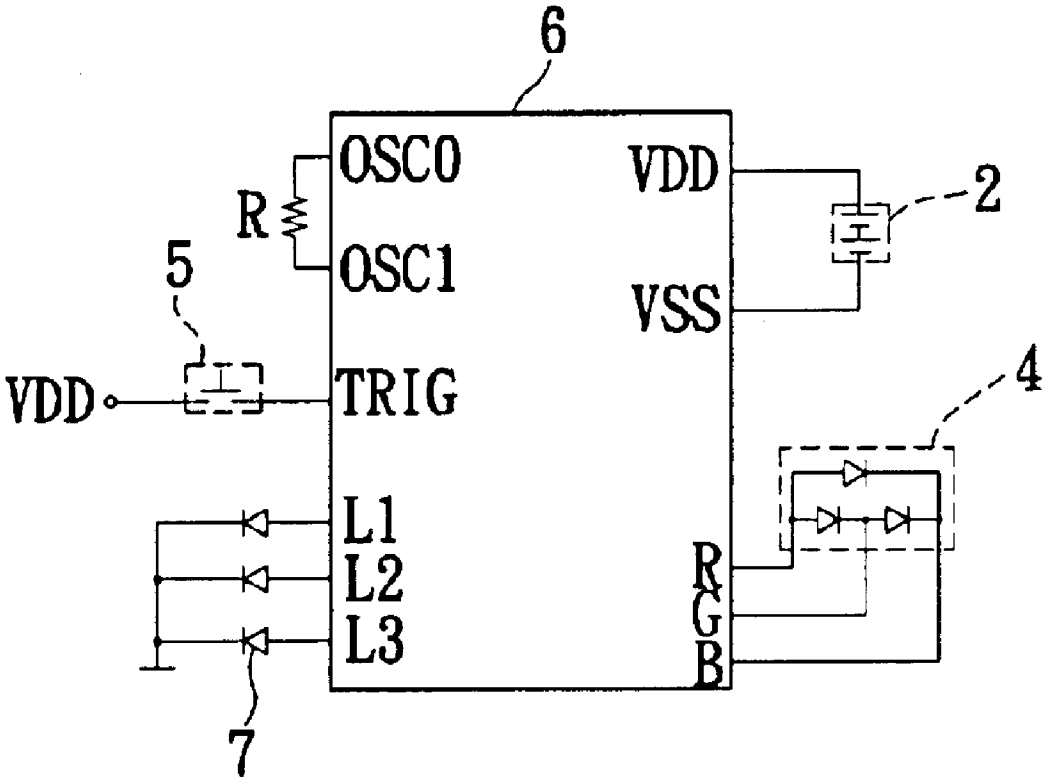
FIG. 3 is a circuit pin diagram of a control IC of an embodiment of the present invention.

As shown in FIG. 3, the control IC 6 is electrically connected with the power source 2, the color-mixing LED 4, the vibration switch 5 and a vibration resistor R. In order to make the color-mixing LED 4 radiate normally, a voltage of 4.5V or 6V is used. In order to further increase lighting variations of the shoe light device, in addition to the primary light of the color-mixing LED 4, several secondary lights LEDs 2 are also electrically connected with the control IC 6.

Figure 4:
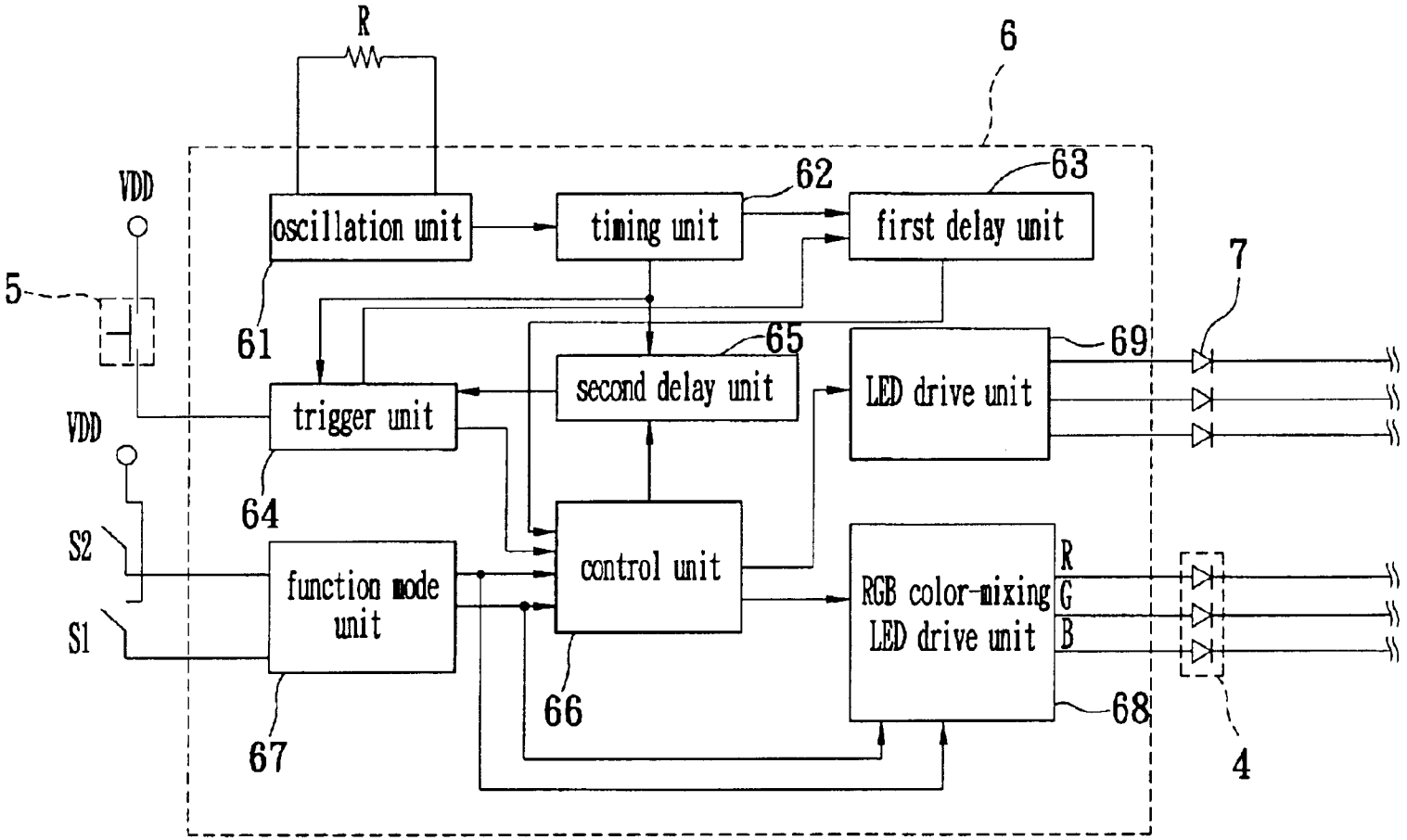
FIG. 4 is a circuit block diagram of a control IC of an embodiment of the present invention.

As shown in FIG. 4, the control IC 6 is composed of an oscillation unit 61, a timing unit 62, a first delay unit 63, a trigger unit 64, a second delay unit 65, a control unit 66, a function mode unit 67, a RGB color-mixing LED drive unit 68 and a LED drive unit 69.

The oscillation unit 61 and the timing unit 62 are used to generate a work frequency to the first delay unit 63, the trigger unit 64 and the second delay unit 65. The trigger unit 64 is electrically connected to the vibration switch 5. When the vibration switch 5 is vibrated, the trigger unit 64 generates a trigger signal to the first delay-unit 63 and the control unit 66. The first delay unit 63 is used to determine a delay time after which the control IC 6 sends a drive signal to the color-mixing LED 4 upon receiving the trigger signal. The second delay unit 65 is used to determine a flashing episode in which the control IC 6 sends a drive signal to the color-mixing LED 4 after the control IC 6 receives the trigger signal. Moreover, the control unit 66 disables any new trigger signal generated in the flashing episode.

The control unit 66 controls illumination of the color-mixing LED 4 according to the received trigger signal. The function mode unit 67 switches the light color table by switches S1 and S2 to determine illumination variations of the color-mixing LED 4. In this embodiment, the light color table can be divided into a male mode and a female mode. In the male mode, the color-mixing LED 4 has five colors, blue, red, white, orange and green, that radiate circularly. In the female mode, the color-mixing LED 4 has five colors, blue, red, white, violet and green, that radiate circularly. However, colors of the above light color table are not limited to five colors. Colors of the light color table can be rearranged according to necessity to make the color-mixing LED 4 show multiple colors.

The RGB color-mixing LED drive unit 68 receives the drive signal from the control unit 66 to control the illumination of the color-mixing LED 4 according to the light color table. The LED drive unit 69 receives the drive signal from the control unit 66 to control the illumination of a plurality of monochrome LEDs 7.

The trigger unit 64 generates a trigger signal to the control unit 66 when the vibration switch 5 is vibrated. The control unit 66 then sends out a drive signal to the RGB color-mixing LED 68 after a delay time determined by the first delay unit 63. Meanwhile, the color-mixing LED 4 radiates variably according to the light color table in a flashing episode determined by the second delay unit 65. If the light color table is switched to the male mode, the color-mixing LED 4 radiates the blue, red, white, orange and green lights in turn. If the light color table is switched to the female mode, the color-mixing LED 4 radiates the blue, red, while, violet and green lights in turn.

Figure 5:
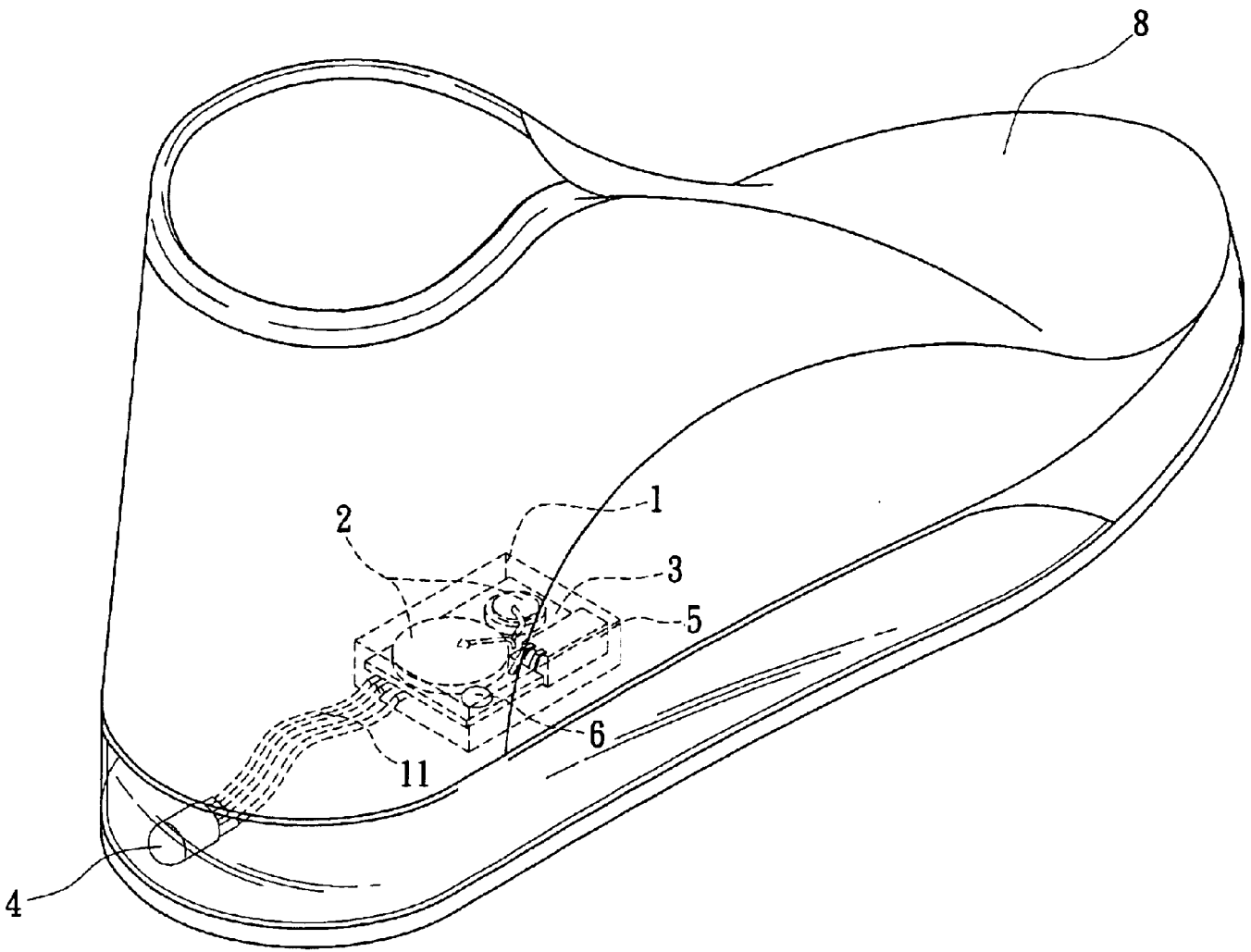
FIG. 5 is a diagram showing installation of an embodiment the present invention in a shoe.

As shown in FIG. 5, the shoe light device in FIG. 2 is installed in a shoe 8, and the color-mixing LED 4 is exposed on a visible portion outside the shoe 8. When a wearer wearing the shoe walks, the color-mixing LED 4 radiates the blue, red, white, orange and green colors in turn or the blue, red, white, violet and green colors in turn according to his/her steps. Therefore, when the wearer wearing the shoe 8 walks, light in multiple color variations is displayed to enhance the fun of wearing the shoe 8 and to create a more dazzling effect.

Although the present invention has been described with reference to the preferred embodiments thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A full-color shoe light device comprising:

at least a color-mixing LED composed of several light-emitting chips of different colors integrated in a single lamp-shape package, said color-mixing LED being used to generate light of various colors;

a power source for providing electricity for said color-mixing LED;

a vibration switch for generating a trigger signal when vibrated; and a control IC for generating a drive signal to control a lighting duration of each light-emitting chip in said color-mixing LED to emit light of multiple colors in a flashing episode after receiving said drive signal.

2. The full-color shoe light device as claimed in claim 1, wherein said color-mixing LED is composed of light-emitting chips of red, green and blue colors.

3. The full-color shoe light device as claimed in claim 1, wherein said color-mixing LED has 3 or 4 pins.

4. The full-color shoe light device as claimed in claim 1, wherein said color-mixing LED is installed on a visible portion of a shoe.

5. The full-color shoe light device as claimed in claim 1, wherein said power source is a 4.5V power source, and is composed of a 3V battery and a 1.5V battery.

6. The full-color shoe light device as claimed in claim 5, wherein said 3V battery is a lithium battery.

7. The full-color shoe light device as claimed in claim 6, wherein said lithium battery is a CR-2032 or CR-2450 lithium battery.

8. The full-color shoe light device as claimed in claim 1, wherein said power source is a 6V power source.

9. The full-color shoe light device as claimed in claim 8, wherein said 6V power source is composed of two 3V lithium batteries.

10. The full-color shoe light device as claimed in claim 9, wherein said lithium batteries are CR-2032 or CR-2450 lithium batteries.

11. The full-color shoe light device as claimed in claim 1, wherein said control IC comprises:

a trigger unit electrically connected to said vibration switch and used to generate said trigger signal;

a color-mixing LED drive unit for driving said color-mixing LED to emit light; and a control unit used to receive said trigger signal, and to generate and send said drive signal to said color-mixing LED drive unit to make said color-mixing LED emit multiple colors according to a light color table.

12. The full-color shoe light device as claimed in claim 11, wherein said control IC further comprises a function mode unit to control color variation of said light color table by switches.

13. The full-color shoe light device as claimed in claim 11, wherein said control IC is further electrically connected to several monochrome LEDs.

14. The full-color shoe light device as claimed in claim 11, said control IC further comprising a first delay unit, wherein said first delay unit determines a delay time, whereafter said control IC generates and sends said drive signal to said color-mixing LED upon receiving said trigger signal.

15. The full-color shoe light device as claimed in claim 11, said control IC further comprising a second delay unit, wherein said second delay unit determines a length of said flashing episode.

16. A full-color shoe light device comprising:

at least a color-mixing LED composed of several light-emitting chips of different colors, said color-mixing LED being used to generate light of various colors;

a power source for providing electricity for said color-mixing LED;

a vibration switch for generating a trigger signal when vibrated; and a control IC for generating a drive signal to said color-mixing LED to emit light of multiple colors in a flashing episode after receiving said drive signal, wherein said control IC disables any trigger signal generated in said flashing episode.

* * * * *